US006732834B2

(12) United States Patent
Colorado

(10) Patent No.: US 6,732,834 B2
(45) Date of Patent: May 11, 2004

(54) COMBINATION TRUCKER'S BELT AND EXTRICATION HARNESS

(76) Inventor: Juancarlos Colorado, P.O. Box 2111, Petaluma, CA (US) 94952

( * ) Notice: Subject to any disclaimer, the term of this patent is extended or adjusted under 35 U.S.C. 154(b) by 0 days.

(21) Appl. No.: 10/024,257

(22) Filed: Dec. 17, 2001

(65) Prior Publication Data

US 2002/0074185 A1 Jun. 20, 2002

Related U.S. Application Data

(60) Provisional application No. 60/256,146, filed on Dec. 15, 2000.

(51) Int. Cl.[7] ..... A62B 1/16
(52) U.S. Cl. ..... 182/6; 182/3
(58) Field of Search ..... 182/3, 6, 9, 187; 24/32, 31 C, 31 R; 2/311

(56) References Cited

U.S. PATENT DOCUMENTS 1,600,027 A * 9/1926 Welsand ..... 224/223
1,971,571 A * 8/1934 McMullen ..... 182/9
4,197,816 A * 4/1980 Lusch ..... 182/3
4,763,609 A * 8/1988 Kulik ..... 119/797
5,067,585 A * 11/1991 Bell ..... 182/7
5,269,023 A * 12/1993 Ross ..... 2/66
5,505,356 A * 4/1996 Noriega et al. ..... 224/250
5,839,932 A * 11/1998 Pierce et al. ..... 441/80
5,970,517 A * 10/1999 Jordan ..... 2/69
6,481,528 B2 * 11/2002 Antonio ..... 182/6

FOREIGN PATENT DOCUMENTS

WO 47404 * 10/1998

* cited by examiner

*Primary Examiner*—Alvin Chin-Shue
(74) *Attorney, Agent, or Firm*—Johnson & Stainbrook, LLP; Larry D. Johnson; Craig M. Stainbrook

(57) ABSTRACT

A combination trucker's belt and extrication harness is provided, said combination including a belt having loop portions and connection means at each of its ends, and a multi-use strap affixed to the second end and contained within a quick-open hook-and-loop fabric pouch. The multi-use strap includes a first ring connected to the loop portion of the second end of the belt, a short strap connected at one of its ends to the first ring and connected at its other end to a second ring, a long strap connected to the second ring and extending from the second ring through a snap connector having adjustment means and a tail portion extending beyond the snap connector which terminates in a third ring. The multi-use strap may be deployed for multiple uses, including aerial platform tethering, search tethering, and for configuring as a leg and pelvis reinforcement making the combination suitable as a low angle rescue harness and emergency rappelling harness.

11 Claims, 8 Drawing Sheets

COMBINATION TRUCKER'S BELT AND EXTRICATION HARNESS

CROSS REFERENCE TO RELATED APPLICATIONS

The present application claims the benefit of the filing date of U.S. Provisional/Utility Application Ser. No. 60/256,146, filed Dec. 15, 2000.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to climbing and personal safety harnesses, and more particularly to a combination trucker's belt and extrication harness having a rapid deployment multi-use strap adapted for use by rescue and paramilitary personnel, and particularly well-suited for use by firefighters working in burning structures.

BACKGROUND INFORMATION AND DISCUSSION OF RELATED ART

Firefighters routinely confront the danger of entrapment in burning buildings, some of which are multistory buildings. When rapid egress or escape is necessary, it is common for firefighters to use a rope in connection with an emergency climbing harness to rappel to a safe level or to the ground. The equipment currently needed for this feat is heavy, bulky, and potentially dangerous to haul about during firefighting maneuvers. Accordingly, firefighters are reluctant to carry it into a burning structure. Furthermore, the process of putting on the equipment and then deploying it for use can be time consuming and complicated in an urgent situation, particularly when a broiling sea of smoke churns the air and blinds and chokes the firefighter.

The field of firefighter safety equipment includes several commendable attempts at addressing this problem, including an earlier patented extrication harness invented by the present inventor and disclosed in U.S. Pat. No. 6,105,169. The apparatus disclosed therein comprises a harness strap assembly similar in design and function to a climbing harness, but incorporated into the liner of the pants of a firefighter's turnout suit. The suit liner is modified by the addition of two or more belt loops, each of which incorporate snaps or hook and loop fastener patches for inserting and releasing the harness strap itself, but these loops preferably will be sewn or riveted shut.

Other prior art devices of note in the firefighting safety equipment field include: U.S. Pat. Nos. 5,036,548 and 5,136,724 teach forms of combined firefighters' turnout pants and safety harness; U.S. Pat. No. 3,973,643, which teaches a firefighters' safety coat with detachable harness; and U.S. Pat. No. 2,979,153, which discloses a safety suit with built-in harness. Relevant designs from related fields but not necessarily adapted (either well or at all) for firefighter use include U.S. Pat. No. 5,857,540, which discloses a harness comprising an elongated belt, having two straps that may be converted into leg straps; U.S. Pat. No. 5,145,027, which teaches a roping sit harness for climbing or caving, comprising a pair of thigh loops in the form of closed loops and a belt with a central clasping device; and U.S. Pat. No. 5,615,750, which discloses a climbing harness having adjustable leg loops and rise.

Despite the thoughtful and occasionally important contributions to the field of climbing harnesses generally, and more particularly to personal safety and extrication harnesses, there remains a need for an improved extrication harness that is easy to transport, and rapid and uncomplicated in deployment and use. The combination trucker's belt and extrication harness of the present invention entirely accomplishes these ends.

SUMMARY OF THE INVENTION

The express objective of the present invention is to teach a new and improved combination firefighter trucker's belt and extrication harness. The belt/harness combination comprises a waistband terminating in a first end having an adjustment buckle assembly which connects to a V-ring on a second end of the waistband, and interposed between the two ends are a number of integral features, including ax holder rings, and a strip of fabric sewn into the waistband so as to form a succession of fabric loops adapted for carrying equipment and tools.

The inventive combination includes at least one multi-use strap which is folded and contained within a pouch on the side of the waistband. The pouch is formed by a back section of fabric attached to the waistband and a plurality of fabric flaps which folded inwardly over the back section. Flaps are secured to and opposing flap with surface fasteners.

The multi-use strap comprises a short strap of webbing attached at its first end to a D-ring which overlays the waistband V-ring. It is connected at its second end to an O-ring. A long strap of webbing extends from the same O-ring through a snap connector to its tail portion that terminates in a Shane ring. The snap connector may be adjusted and securing in its position along the length of the long strap.

Because of the configuration of the multi-use strap when deployed, it may be used for a number of practical purposes, including as a tether to a ladder or an aerial platform, a search tether, a connection for bearing a heavy load, or as a leg reinforcement strap for providing pelvic support when using the belt/harness to rappel in a low angle bailout or rescue operation.

DETAILED DESCRIPTION OF THE INVENTION

Figure 1:
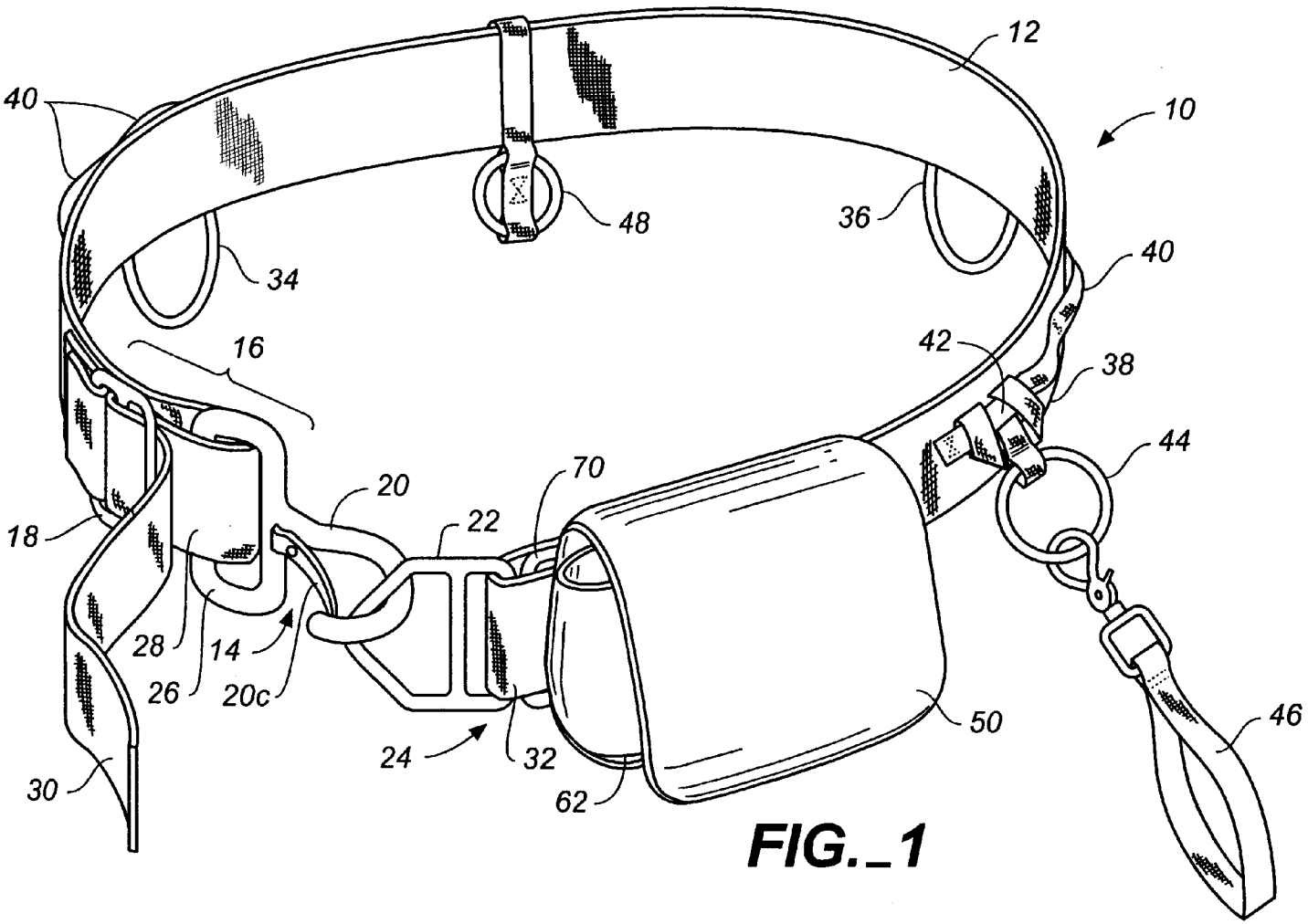
FIG. 1 is a perspective view of a first preferred embodiment of the combination trucker's belt and extrication harness of the present invention.

Referring to FIGS. 1 through 6, wherein like reference numerals refer to like components in the various views, FIG. 1 is a perspective view of a first preferred embodiment of the combination trucker's belt and extrication harness of the present invention, generally denominated 10 herein. The belt/harness combination comprises a waistband or belt portion 12, preferably fabricated of aramid fiber (i.e., KEVLAR®) webbing or other suitably sturdy natural or synthetic, heat and fire resistant material. The waistband portion of the assembly terminates at its first end 14 in an adjustment buckle assembly 16 which includes an adjustment buckle 18, a main buckle snap connector 20 adapted for coupling with a V-ring 22 at the second end 24 of the waistband. The waistband is doubled-back through the loop 26 of snap connector 20 to form a first terminal loop portion 28, the length of which is adjustable via adjustment buckle 18 by grasping and pulling free end 30 forward, i.e., away from the wearer and toward the midline of the wearer's body (see also FIG. 6). Second end 24 is also doubled-back through V-ring 22 so as to form a second terminal loop portion 32. Snap connector 20 preferably includes wings 20A, 20B, on its spring 20C, so that the snap may be easily manipulated by a user wearing gloves.

The belt/harness of the present invention preferably includes a number of integral features. For instance, the belt/harness may include a plurality of tool holding means, including first and second ax holders 34, 36 sewn directly into the lower edge of waistband 12, and at least one strip of fabric 38 sewn into the waistband so as to form a succession of shallow and tight fabric loops 40. The sewing schedule of fabric strip 38 may also form one or more loose fabric loops 42 having a permanent ring 44, all of which are adapted for connecting various rings, straps or accouterments. It may be desirable, for instance, to attach a flashlight/chainsaw holder 46 to ring 44. The fabric loops may be sized to fit the tools to be used by the wearer, such as gloves, rope bags, axes, and so forth. It is also known, for instance, to hook fire hose to a harness to facilitate the carrying of hose into burning buildings, and the present invention lends itself to modification for this purpose.

When intended for use in firefighting, the belt/harness may also include a back ring 48 for use in securing the lower portion of a self-contained breathing apparatus (SCBA), or as a tag line point.

The essence of the trucker's belt of the present invention rests in the inclusion of at least one multi-use strap which is folded and contained within a quick-open pouch 50.

Figure 2A:
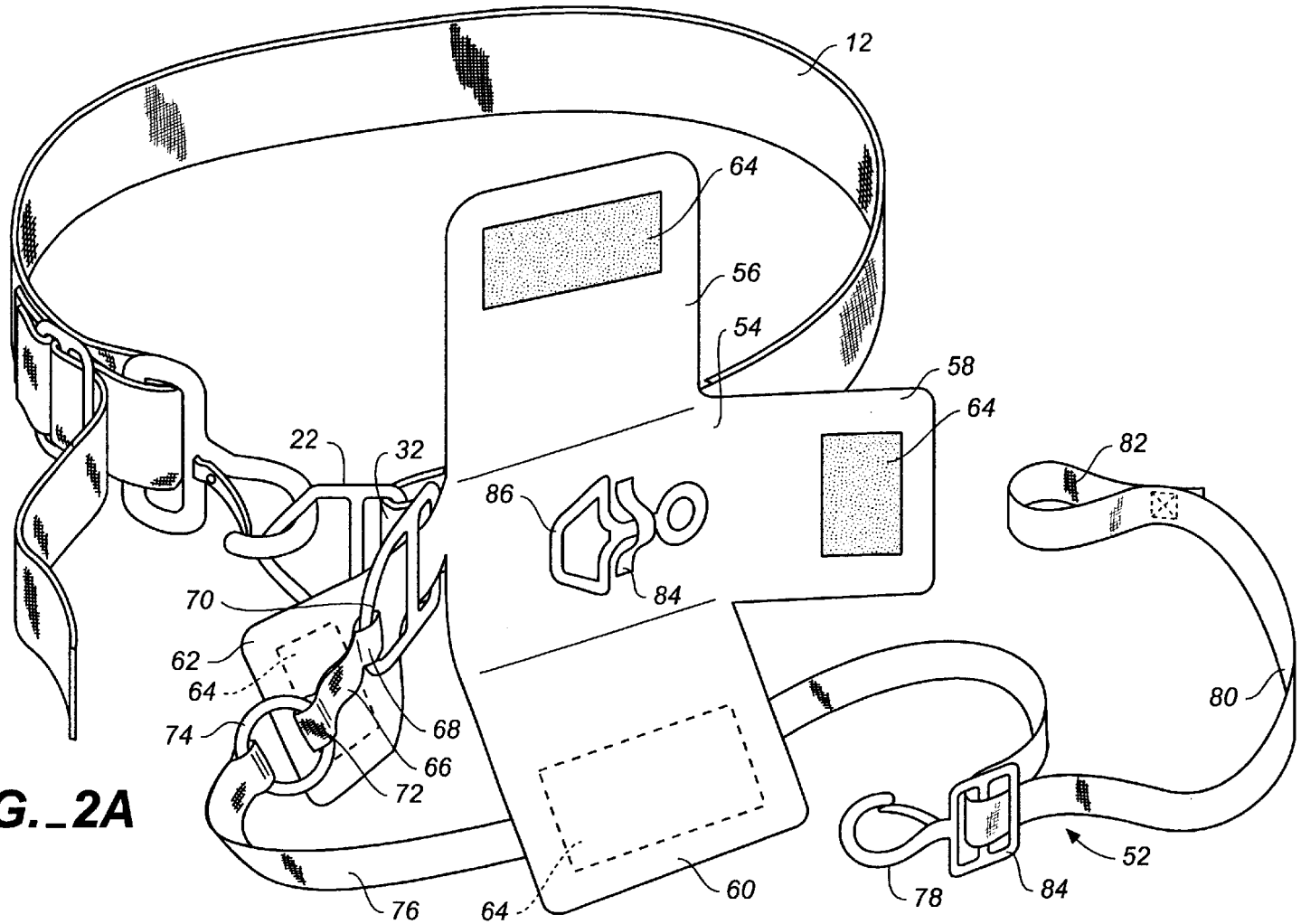
FIG. 2A is a perspective view showing the apparatus of FIG. 1 with the multi-use strap deployed and the multi-use strap pouch open.
Figure 2B:
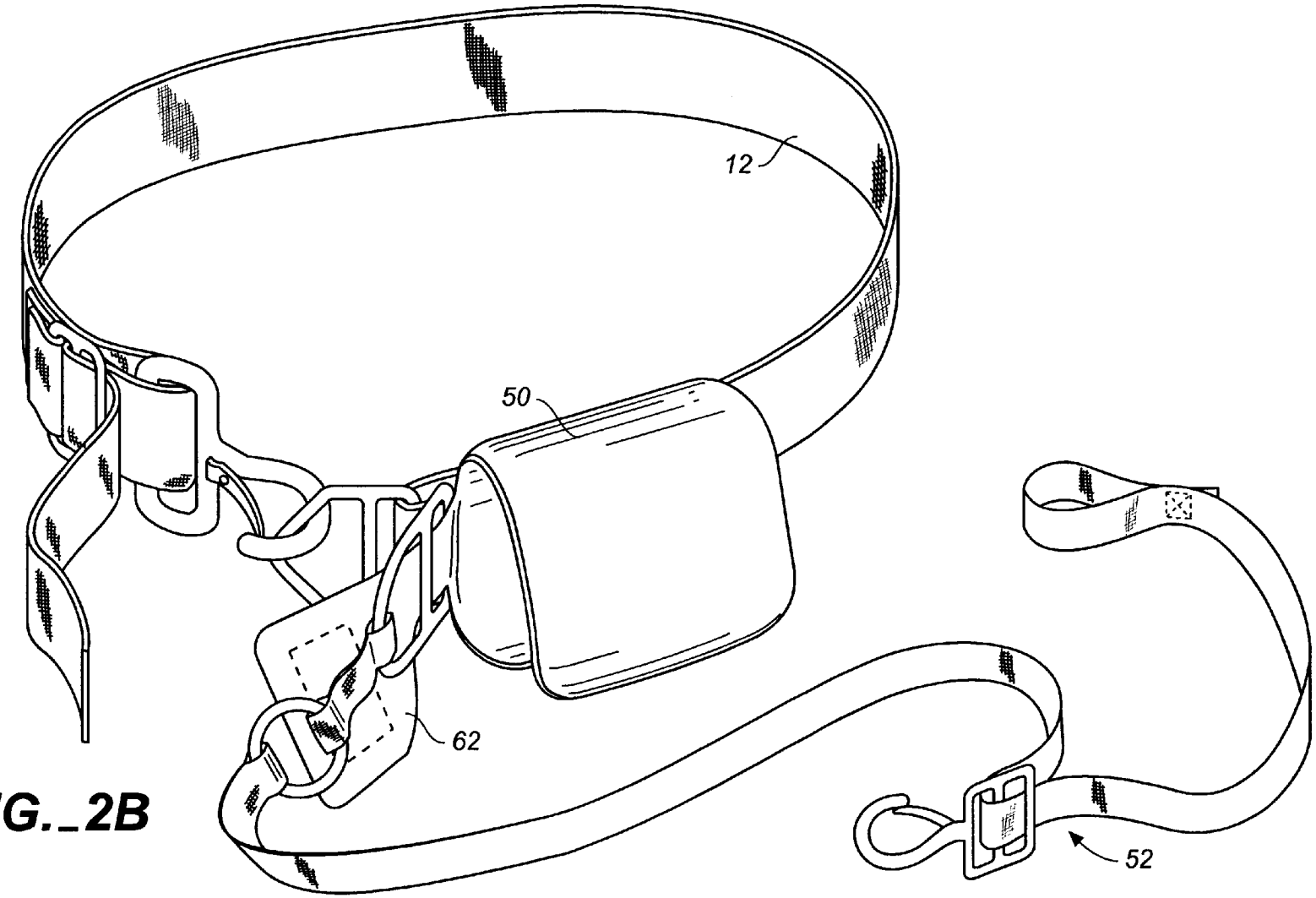
FIG. 2B is a perspective view showing the apparatus of FIG. 1 with the multi-use strap deployed and the multi-use strap pouch closed.

FIG. 2A is a perspective view showing the apparatus of FIG. 1 with a multi-use strap 52 deployed and the multi-use strap pouch open, while FIG. 2B is a perspective view showing the multi-use strap deployed and the multi-use strap pouch closed. Together these views illustrate that the hollow of the pouch 50 is formed by a back section 54 of fabric sewn to the waistband 12, and a plurality of fabric flaps 56, 58, 60, and 62, folded inwardly and secured to an opposing flap with surface fasteners 64. The surface fasteners are preferably hook and loop fasteners, but a number of fastening means may be employed, including, without limitation, snaps.

The multi-use strap comprises a short strap 66, preferably KEVLAR® (aramid fiber) webbing approximately one inch (1") in length, attached at its first end 68 to a D-ring 70. D-ring 70 overlays V-ring 22 and is connected to second terminal loop portion 32 of waistband 12. Short strap 66 connects at its second end 72 to a ring 74, preferably an O-ring. A long strap 76, preferably aramid fiber and approximately 1½ feet in length, extends from O-ring 74 through a snap connector 78 and includes a tail portion 80 that terminates in a reinforced fabric ring, or a Shane ring 82. The snap connector 78 has means, structure 84, for adjusting and securing its position along the length of long strap 76.

Pouch 50 may also include devices used in connection with extrication procedures, or other devices. For instance, back section 54 may include an elastic or hook and loop fastener 84 to secure an eight plate 86, a carabineer, or like hardware.

Referring now to FIG. 2B, pouch 50 may be completely or partially closed when multi-use strap 52 is deployed. In this figure, flap 62 is shown open while all others are closed.

Figure 3:
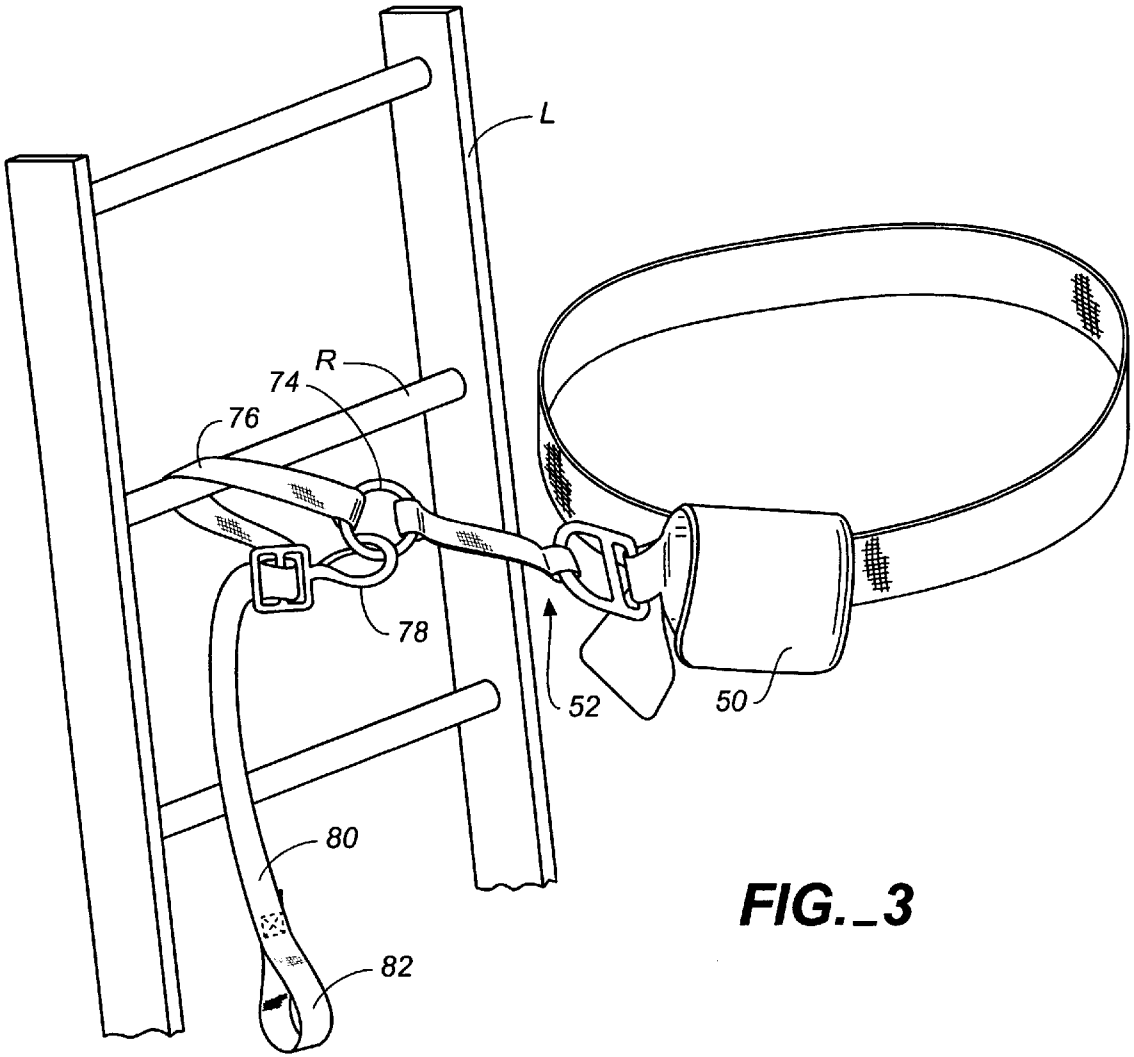
FIG. 3 is a perspective view showing one of the many uses of the multi-use strap.

FIG. 3 is a perspective view showing one of the many uses of the multi-use strap. In this illustration, the multi-use strap is used to secure the belt (and thus the wearer) to a ladder. The steps for accomplishing this procedure include the following: (1) mounting the ladder L; (2) opening the multi-use strap pouch 50 and releasing multi-use strap 52; (3) wrapping the long strap 76 around a rung R of the ladder above the waist of the wearer but below the shoulders; (4) clipping snap connector 78 to O-Ring 74; and (5) pulling on the long strap tail 80 to adjust the strap to its desired tension. Disconnecting the multi-use strap entails nothing more than loosening the long strap at the snap connector and unclipping the snap connector from the O-ring.

Figure 4:
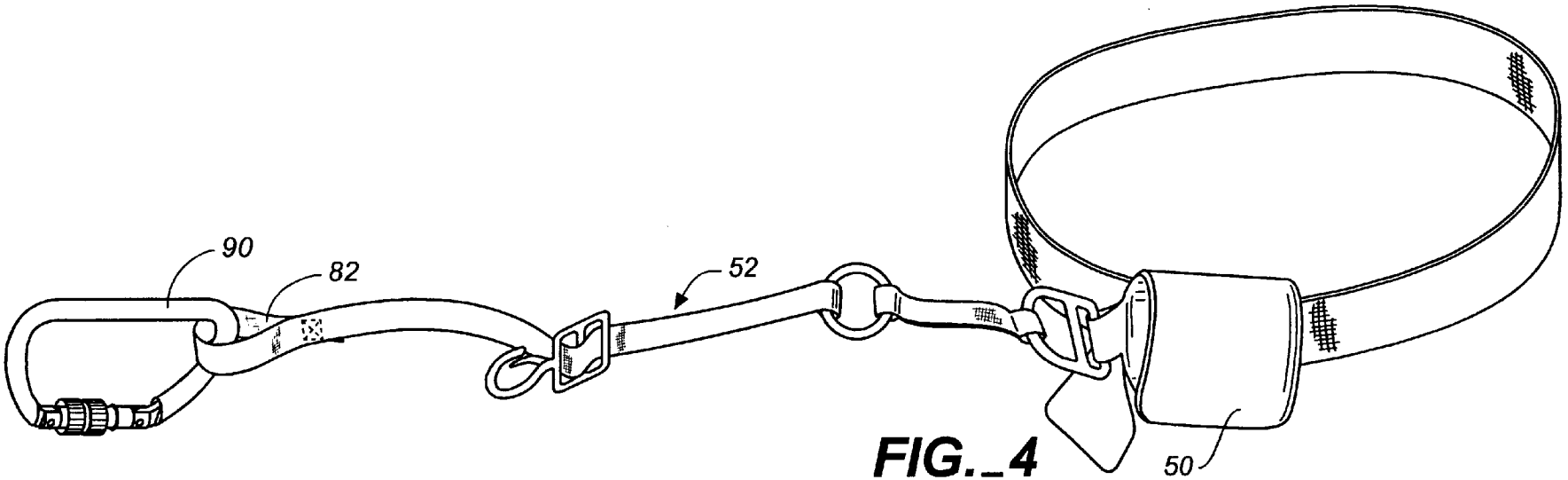
FIG. 4. is a perspective view showing the multi-use strap with a carabineer attached for tethering the belt to a secure structure.

FIG. 4. is a perspective view showing the multi-use strap with a carabineer attached and in a configuration suitable for tethering the belt to a secure structure. In this instance, the multi-use strap 52 is deployed from its pouch 50 and a carabineer 90 is connected at the Shane ring 82 at the terminal end of the strap. To secure the belt/harness to an aerial platform, the user simply clips the carabineer to a suitable anchor point.

Figure 5A:
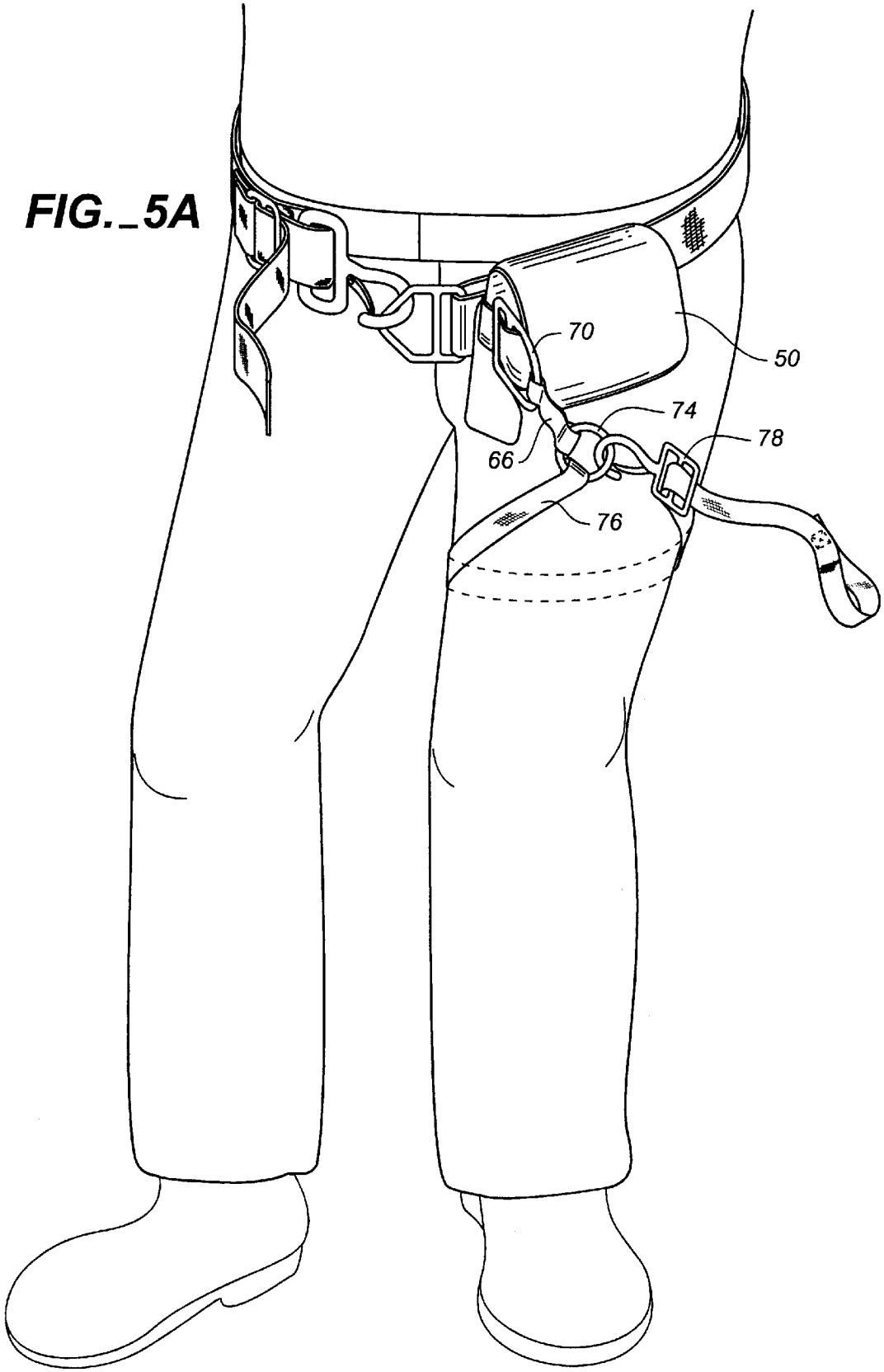
FIG. 5A is a perspective view showing the belt as worn, and more particularly shows the multi-use strap deployed and secured around the wearer's left leg to provide additional reinforcement for bearing loads.
Figure 5B:
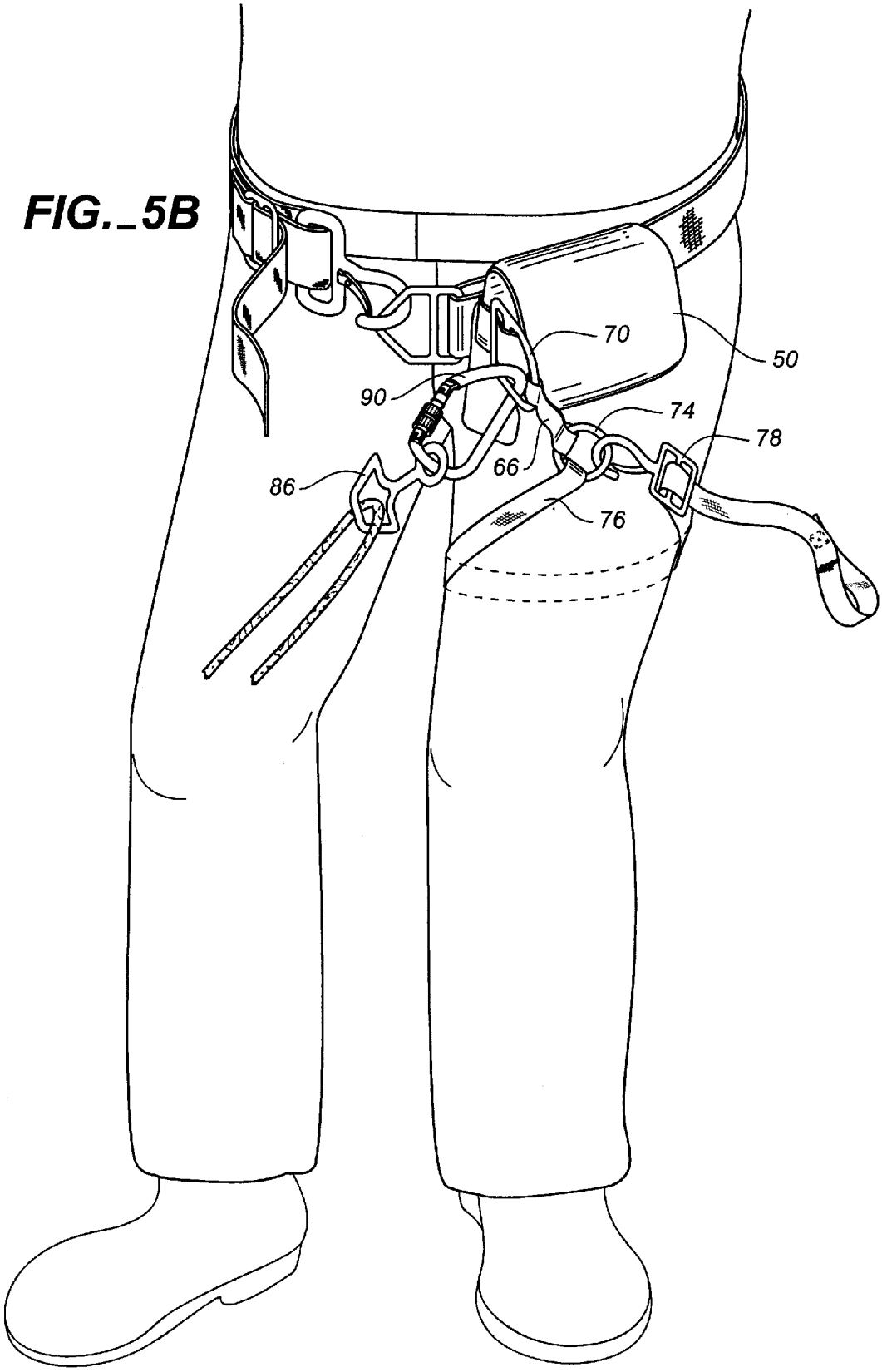
FIG. 5B shows the belt in a configuration suitable for use in rappelling.

FIG. 5A is a perspective view showing the belt as worn, and more particularly shows the multi-use strap deployed and secured around the wearer's left leg to provide additional reinforcement for bearing loads, while FIG. 5B shows the belt in a configuration suitable for use in rappelling. These figures show that regardless of the side on which pouch 50 is located, the multi-use strap 52 when deployed is suitable for wrapping around either leg, according to user preference. This configuration makes the belt/harness suitable to bear heavy loads and particularly well-suited for functioning as an low angle rescue harness. It should be noted that pouch 50, as shown in FIGS. 5A and 5B, is illustrated as being on the wearer's left side; however, the pouch may be located in either side of the wearer without affecting the functioning of the apparatus. Furthermore, the belt may include two pouches for two multi-use straps, as is discussed more a fully below.

Multi-use strap 52 has generally free radial movement because of the fabric and rigid ring assembly of short strap 66, D-ring 70, and O-ring 74. When D-ring 70 is properly positioned proximate the body midline, this assembly permits multi-use strap 52 to be swung over and diagonally across either side of the crotch for looping of snap 78 underneath, around and in front of either leg for connection to O-ring 74, thus providing leg and pelvic support to load bearing operations. When used as a bailout rappelling strap, a carabineer 90 is coupled to D-ring 70 and an eight plate 86 (or other suitable descent device) is also coupled to the carabineer. A rope and other descent gear may then be connected to the eight plate.

As may be readily appreciated by those having skill in the art, the present invention may be designed as an independent unit or, alternatively, it may be incorporated into a firefighter's SCBA harness or firefighter's turnout clothing ensemble.

Of note, once the multi-use strap is deployed and configured as shown in FIGS. 5A and 5B, and the strap adjusted via snap connector 78, there is no load placed on the pouch. Accordingly, the multi-use pouch need not be strongly attached to the belt, and it is even preferable that it be removable and adjustable to tailor the location to the wearer's preferences and to the other accouterments he/she will be bearing.

In another preferred embodiment, the combination trucker's belt and extrication harness of the present invention comprises two multi-use straps, each having the above-described structure and each of which is deployed from a pouch one side of the waistband positioned proximate one of the ends of the waistband. One pouch is located in rough proximity to the right iliac crest of the wearer, while the other pouch is located in rough proximity to the left iliac crest of the wearer. In such a "dual strap" design, the straps deploy in precisely the same fashion as has been described above and shown in FIGS. 1–6; each strap, however, is wrapped around only one leg of the user so that each leg is employed to reinforce load bearing strength and even greater balance is achieved.

Figure 6:
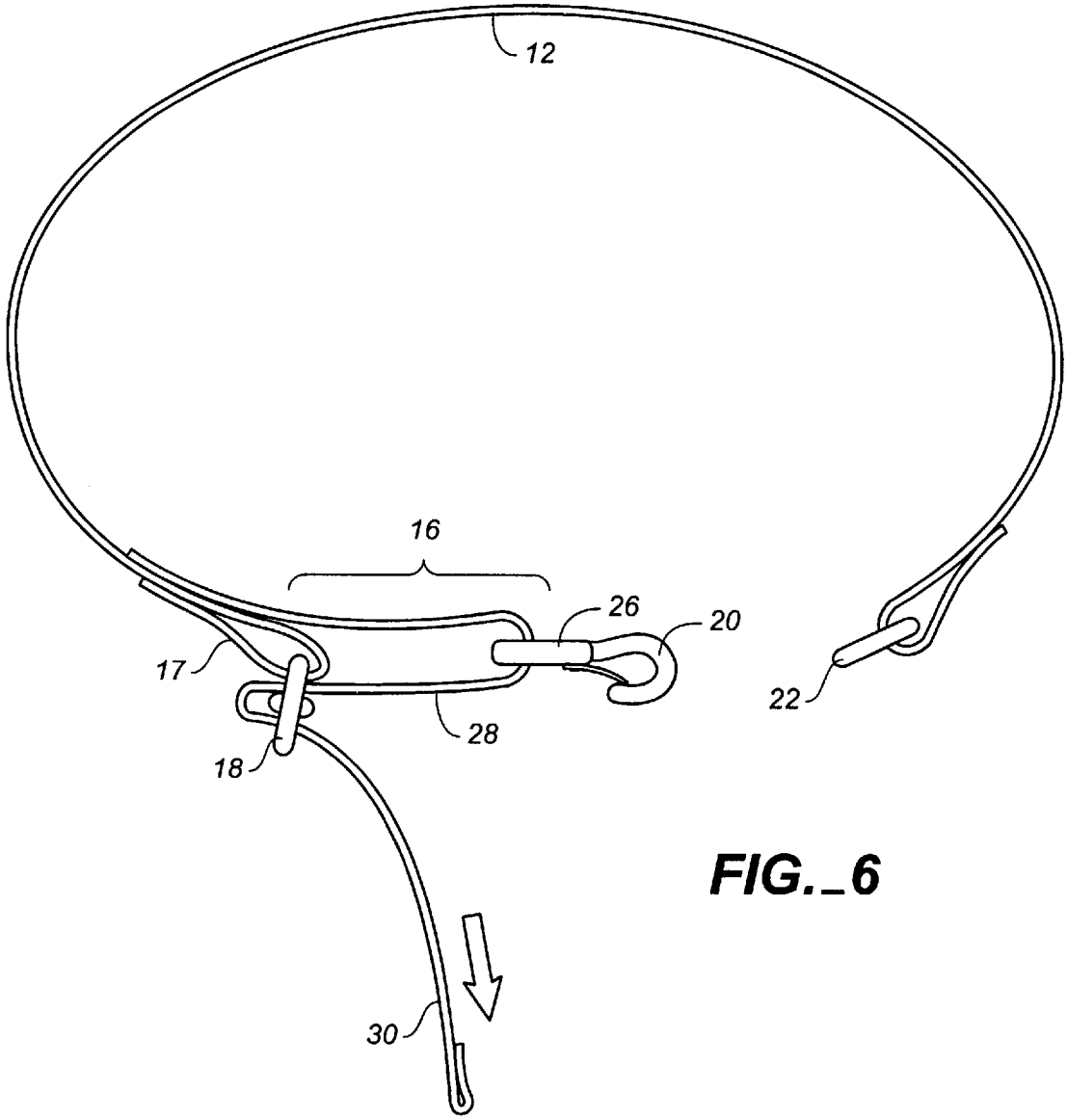
FIG. 6 is a top view highlighting the mechanical elements of the front buckle assembly.

Finally, FIG. 6 is a top view highlighting the mechanical elements and mechanical advantages of the front buckle assembly. This view shows that adjustment buckle assembly 16 comprises an adjustment buckle 18 fastened to waistband 12 by an integral fabric loop 17, a main buckle snap connector 20 which couples to V-ring 22. As noted, the waistband is doubled-back, or threaded, through the loop 26 of main buckle snap connector 20 to form a first terminal loop portion 28, the length of which is again doubled-back through adjustment buckle 18. The snugness of the belt is thus adjustable by pulling free end 30 forward, i.e., away from the wearer. In effect, then, tightening the belt by the wearer actually entails pushing the free end away from the center of the wearer's body. This in itself provides an advantage to the wearer, inasmuch as the muscles recruited to perform this task are primarily the pectoralis major, which are substantially stronger than the posterior deltoids and the biceps, which would be the muscles recruited to perform the task of pulling the free end of the waistband if it were to be pulled rearward, as is the case with prior art devices. Furthermore, it will be readily recognized that the adjustment buckle assembly 16 is essentially a pulley system much like that of a block and tackle, with its attendant mechanical advantages.

In another aspect, the inventive apparatus may be characterized as a combination tool belt and rescue harness, comprising a waistband having a two ends, and wherein each of the waistband ends terminates in a loop and includes means for coupling to the other end. The apparatus further includes at least one multi-use strap affixed to a loop portion of one of the ends of the waistband. The multi-use strap has a contained and a deployed configuration. The multi-use strap comprises first, second and third rings, a snap connector, and a short and long strap. The first ring is connected to one of the loop portions at an end of the waistband. A short strap is connected at one end to the first ring and at its other end to the second ring. The long strap is connected to the second ring and extends from the second ring through the snap connector, which has adjustment means for adjusting the position of the snap connector along the length of the long strap. The long strap has a tail portion extending beyond the snap connector which terminates in a connection to the third ring. Finally, the apparatus includes at least one pouch so that each of the multi-use straps may be selectively contained within or deployed from one of the pouches, respectively. The first and second rings are preferably of a geometry that permits free radial movement of the straps when deployed, such as D-rings and O-rings.

In this aspect, when the strap is deployed from the pouch, the wearer pulls the long strap between his legs and wraps it around one leg such that the snap connector can be connected to the second ring to secure the multi-use strap around the upper leg immediately below the buttocks. Load bearing devices may then be attached to the first ring.

While this invention has been described in connection with preferred embodiments thereof, it is obvious that modifications and changes therein may be made by those skilled in the art to which it pertains without departing from the spirit and scope of the invention. For instance, it will be readily appreciated by those with skill in the art that the trucker's belt and extrication harness combination of the present invention could be fabricated from a variety of materials consistent with the intended uses. The construction materials may be directed for use by ski patrol personnel to assist in extricated stranded skiers on ski lifts, or by police or military personnel for a lightweight, easy-to-use rappelling device. Accordingly, the scope of this invention is to be limited only by the appended claims.

What is claimed as invention is:

1. A combination trucker's belt and extrication harness, comprising:

a belt portion having a first and a second end, each of said first and said second ends having a loop portion, said belt portion for wearing around a user's waist;

first and second connection means at each of said first and said second ends of said belt portion for coupling said first end to said second end, each of said connection means having a loop portion;

at least one pouch attached to said belt portion;

at least one multi-use strap affixed to said second end and selectively contained within and deployed from said pouch, said multi-use strap comprising a first ring connected to said loop portion of said second end of said belt portion, a short strap having a first end connected to said first ring and a second end connected to a second ring, a long strap connected to said second ring and extending from said second ring through a snap connector having adjustment means and a tail portion extending beyond said snap connector which terminates in a third ring, said multi-use strap providing means when deployed for selectively anchoring a wearer to a stationary object, looping around the leg of the wearer to function as an extrication harness leg strap, and/or bearing a load; and an adjustment buckle assembly disposed proximate said first connection means at said first end of said belt portion, said adjustment buckle assembly including an adjustment buckle fastened to said belt portion proximate said loop portion of said first connection means, a first terminal loop portion formed by said belt portion threaded through said loop portion of said first connection means and doubled-back and threaded through said adjustment buckle and then double-back through said adjustment buckle so as to leave a free end of said belt portion, thereby providing the mechanical advantages of a block-and-tackle-type mechanical transmission, and such that when in use, the length of said first terminal loop portion is shortened by pushing said free end forward and away from the wearer.

2. The combination trucker's belt and extrication harness of claim 1, wherein said first ring of said multi-use strap is a D-ring connected to second loop portion at said second end of said belt portion.

3. The combination trucker's belt and extrication harness of claim 1, wherein said second ring of said multi-use belt is an O-ring.

4. The combination trucker's belt and extrication harness of claim 1, wherein said connection means at said first end of said belt portion comprises a main buckle snap connector having a loop portion.

5. The combination trucker's belt and extrication harness of claim 1, wherein said connection means at said second end of said belt portion comprises a V-ring attached to said loop portion at said second end.

6. The combination trucker's belt and extrication harness of claim 1, further comprising at least one tool holding means.

7. The combination trucker's belt and extrication harness of claim 6, wherein said tool holding means comprises at least one fabric loop sewn into said belt portion so as to form a succession of fabric loops.

8. The combination trucker's belt and extrication harness of claim 1, further comprising at least one ax holder integral with said belt portion.

9. The combination trucker's belt and extrication harness of claim 1, further comprising a back ring.

10. The combination trucker's belt and extrication harness of claim 1, wherein said apparatus includes two multi-use straps.

11. The combination trucker's belt and extrication harness of claim 10, wherein said apparatus includes two of said pouches.

* * * * *